US009677389B2

(12) United States Patent
Boyd et al.

(10) Patent No.: US 9,677,389 B2
(45) Date of Patent: Jun. 13, 2017

(54) DART VALVE ASSEMBLY FOR A BYPASS PLUNGER

(71) Applicant: Flowco Production Solutions, LLC, Spring, TX (US)

(72) Inventors: Garrett S. Boyd, Godley, TX (US); Mitchell A. Boyd, Haslet, TX (US); John M. Lee, Weatherford, TX (US); Garrett W. Winford, Springtown, TX (US)

(73) Assignee: Flowco Production Solutions, LLC, Spring, TX (US)

( * ) Notice: Subject to any disclaimer, the term of this patent is extended or adjusted under 35 U.S.C. 154(b) by 0 days.

(21) Appl. No.: 15/245,740

(22) Filed: Aug. 24, 2016

(65) Prior Publication Data

US 2017/0058652 A1 Mar. 2, 2017

Related U.S. Application Data

(60) Provisional application No. 62/209,549, filed on Aug. 25, 2015.

(51) Int. Cl.
*E21B 43/12* (2006.01)

(52) U.S. Cl.
CPC ..... *E21B 43/121* (2013.01)

(58) Field of Classification Search
CPC ..... E21B 43/121; E21B 34/00; E21B 43/122; E21B 43/123
USPC ..... 166/105
See application file for complete search history.

(56) References Cited

U.S. PATENT DOCUMENTS

| | | | | |
|---|---|---|---|---|
| 2,661,024 | A | 12/1953 | Knox | |
| 6,234,770 | B1 * | 5/2001 | Ridley | E21B 43/121 417/408 |
| 7,055,812 | B2 | 6/2006 | Balsells | |
| 7,290,602 | B2 | 11/2007 | Victor | |
| 7,513,301 | B2 | 4/2009 | Victor | |
| 2004/0070128 | A1 * | 4/2004 | Balsells | F16F 1/045 267/180 |
| 2005/0241819 | A1 | 11/2005 | Victor | |
| 2014/0116714 | A1 | 5/2014 | Jefferies et al. | |
| 2016/0061012 | A1 * | 3/2016 | Zimmerman, Jr. | E21B 43/121 166/329 |

* cited by examiner

*Primary Examiner* — Taras P Bemko
(74) *Attorney, Agent, or Firm* — Whitaker Chalk Swindle & Schwartz PLLC; Stephen S. Mosher

(57) ABSTRACT

A dart valve assembly includes a dart valve and a clutch that restrains the movement of the dart valve within the bore of a dart valve cage or plunger body between a closed and an open position. The clutch includes a clutch bobbin formed of a synthetic material, and both the inside diameter of the clutch bobbin and the outside diameter of the dart valve stem of the dart valve assembly are configured with a sequence of alternating ridges and grooves to improve clutch action through reduced friction.

20 Claims, 5 Drawing Sheets

DART VALVE ASSEMBLY FOR A BYPASS PLUNGER

CROSS REFERENCE TO RELATED APPLICATIONS

The present application for patent claims priority to U. S. Provisional Patent Application Ser. No. 62/209,549 filed Aug. 25, 2015 by the same inventors entitled CLUTCH ASSEMBLY FOR A BYPASS PLUNGER.

BACKGROUND OF THE INVENTION

1. Field of the Invention

The present invention generally relates to bypass plunger for oil and gas operations and more particularly to improvements in the structure of such instruments to provide increased utility and operating life.

2. Background of the Invention and Description of the Prior Art

Bypass plungers for reciprocatingly lifting gas and fluids from a low or non-productive oil or gas well are well known in the art and are available in a wide variety of forms and construction. The requirements for constructing a reliable bypass plunger are well-understood and numerous innovations in their design and construction have appeared over the years. However, such plungers are used in a variety of circumstances and environments, giving rise to failures or inefficiencies that suggest a solution for an improved design or construction is needed.

Conventional bypass plungers take many forms, employing a variety of configurations to enable them to restore production to an oil or gas well that has been shut in or has become dormant because of insufficient pressure in the formation to yield profitable production. A typical bypass plunger is formed as a hollow, cylindrical body that has a valve system at its lower end for alternately opening and closing fluid passages through the body of the plunger. When the valve system is open, the plunger is allowed to fall through a well bore as the fluid contained in the well bore flows through the hollow body. When the plunger reaches the bottom of the well bore the valve system closes off the hollow interior of the plunger body so that the plunger forms a piston that may rise upward through the well bore if there is sufficient pressure within the formation to lift the plunger and any fluid or gas above the plunger toward the surface. Upon reaching the surface, a mechanism that functions as a decoupler opens the valve system on the plunger to allow the plunger to once again fall through the well bore. This repetitive reciprocating motion of the plunger thus acts to restore production to the well.

A key mechanism in the bypass plunger is the valve system as used in plungers that use a dart valve system. Attached to the lower end of a typical plunger body may be a hollow extension of the body that includes openings in the side walls of the extension. The extension is called a "cage" because of its hollow structure and the openings formed in its side walls. The openings in the side walls of the valve cage act as ports for the flow of fluids through them when the plunger is descending through the well. The cage forms a fraction of the overall length of the plunger body. Within the cage is a poppet valve having a round valve head attached at its underside to a valve stem. The valve head is a larger diameter portion having a valve face formed on the side of the valve head opposite the stem. The head of the valve is disposed within a chamber inside the plunger body just above the cage. This chamber is shaped to match the shape of the head so that it forms a valve (head) seat. The shaft or valve "stem" of the poppet valve, also called a dart valve that is supported within a cylindrical bore within the valve cage, extends through the open lower end of the cage. The dart valve is allowed to reciprocate within its supporting structure as it alternately moves between a closed (valve head against the internal valve seat in the chamber) and open (valve head disposed away from its seat and the valve stem extending outward below the lower end of the plunger body.

Instead of a valve spring that acts to close the dart valve face against its internal valve seat, a clutch assembly disposed within the supporting structure that surrounds the valve stem is configured to restrain the reciprocating motion of the poppet valve within the valve cage. The clutch grips the dart valve stem with just enough friction to restrain the motion of the valve stem when the plunger is descending or ascending through the well bore. Thus, during descent, the clutch holds the dart valve head away from its valve seat, permitting the fluids in the well to flow through the openings in the side wall of the valve cage. When the plunger reaches the bottom of the well, the outward end of the valve stem extending from the lower end of the valve cage strikes a bumper at the bottom of the well that forces the valve stem to move inward. This action overcomes the grip of the clutch on the stem so that the dart valve head moves against its valve seat to close the valve so that fluids can no longer flow through the valve cage and the plunger body. When pressure in the formation is sufficient, the plunger ascends through the well bore as the clutch holds the dart valve closed. At the surface, a decoupler mechanism acts through the upper end of the hollow plunger body until it strikes the upper end of the valve head. This forces the dart valve head to overcome the grip by the clutch, causing the valve to slide downward to open the valve in preparation for the next descent. The cycle of descent and ascent is allowed to repeat itself as long as the reciprocating "pumping action" of the plunger is needed to restore production.

In conventional bypass plungers and similar devices the clutch portion of a dart valve assembly typically comprises a split bobbin formed of a stainless steel alloy into two identical hemispherical halves. Grooves—usually two—surround the outer diameter of the assembled bobbin halves. A coil spring, which is typically formed from an alloy or stainless steel, is formed into a ring or 'garter' and disposed in each groove around the bobbin to clamp the bobbin halves against the valve stem. The tension in the springs is adjusted to exert just the right amount of clamping pressure of the bobbin halves around the stem of the dart valve to hold the stem from moving during descent or ascent within the well bore. While these materials are durable and can be suited to use in these type of clutches, such clutches are often subject to severe impact during use that shortens their useful life. For example, the momentum of the relatively massive metal bobbin subjects it to substantial impact forces and the likelihood of damage and a shorter useful life. The springs are also subject to damage when they move within their respective grooves and strike the metal bobbin with sufficient force to deform the spring, although this effect may be partly countered by the resilience of the springs.

Such impacts as described above cause failures that result in substantial losses of time and production to retrieve the plunger and repair or replace it so that production can resume. Even though made of robust metal alloys, the components of a dart valve assembly are subject to damage due to impacts, wear due to friction, and deterioration due to high temperatures, caustic substances in the well and the like, which weakens the components of the dart valve assembly and its surfaces. These conditions make conventional assemblies less effective and more susceptible to failure.

What is needed is a more rugged dart valve assembly that provides the needed clutch action yet has a longer life and is still easy to manufacture.

SUMMARY OF THE INVENTION

Disclosed herein is one embodiment of a dart valve assembly for a bypass plunger wherein a dart valve including a valve stem having an outside surface diameter is disposed within a clutch bobbin having an inside surface diameter in contact with the outside surface diameter of a region of the valve stem, comprising: a bobbin formed of synthetic material disposed around the valve stem; and a surface profile fbrmed axially along the inside surface of a the bobbin and along the outside surface of the valve stem; wherein the surface profile includes a series of uniform arc segments forming periodically alternating crests and valleys in the region of contact.

In one aspect the uniform arc segments comprise circular arc segments disposed end-to-end along the respective surfaces; and the circular arc segments face alternately inward and outward of the respective surfaces of the bobbin and the dart valve stem thereby forming the alternating crests and valleys. In another aspect, the arc segments are defined by a radius R relative to a center disposed either side of the respective surfaces by a distance L such that R−L=H, where H is the peak excursion of each crest and valley from the respective surface; a spacing S equal to the length of the chord of an arc segment; wherein the peak excursion is defined by $0.001 \leq H \leq 0.004$ inch.

In another aspect, the surface profile comprises a sinusoid having a peak amplitude value H=+/−(R−L) relative to the nominal surface diameters where L defines a center of a radius R relative to the nominal surfaces of the valve stem OD and the bobbin ID; and a period=2×S where S=base dimension of each crest and valley.

In another aspect, the synthetic material comprises a thermoplastic material selected from the group consisting of oil filled nylon, unfilled nylon 6, filled and unfilled polyetheretherketone, polyaryletherketone, polyetherimide, polyphenylene sulfides, polyamides and variations thereof.

In another embodiment of the present invention, a dart valve assembly for a bypass plunger is disclosed, comprising a dart valve formed of metal, having a valve head attached to a first end of a cylindrical valve stem, the valve stem having an outside diameter (O.D.) surface defined by a first longitudinal surface profile; a clutch disposed around the dart valve stem, the clutch including a split bobbin surrounded by at least one garter spring, the split bobbin formed of a synthetic material and having an inside diameter (I.D.) surface defined by a second longitudinal profile; wherein the first and second longitudinal profiles of adjacent cylindrical a surfaces of the dart valve stem O.D. and the split bobbin I.D. each comprise a uniform sequence of equal amplitude rings alternating with equal amplitude grooves around the dart valve stem O.D. and the split bobbin I.D. such that the grooves are defined by the nominal diameter of the stem or bobbin less an amplitude dimension H and the ridges are defined by the nominal diameter of the stem or bobbin plus an amplitude dimension H; and wherein the first and second surface longitudinal profiles are substantially the same and the amplitude dimension H is defined by 0.001 inch$\leq$H$\leq$0.0045 inch.

In an aspect of the another embodiment, the synthetic material from which the bobbin is formed comprises a thermoplastic material selected from the group consisting of oil filled nylon, unfilled nylon 6, filled and unfilled polyetheretherketone, polyaryletherketone, polyetherimide, polyphenylene sulfides, polyamides and variations thereof; and the clutch comprises at least first and second substantially hemispherical bodies that together substantially encircle the valve stem, the first and second bodies having at least one circumferential groove formed in the outer diameter of each hemispherical body; and a garter disposed in at the least one circumferential groove disposed around the outside of the first and second substantially hemispherical bodies and securing the at least first and second substantially hemispherical bodies against the valve stem.

In yet another embodiment of the present invention there is disclosed a dart valve assembly for a bypass plunger wherein the dart valve assembly comprises a dart valve having a valve head and a cylindrical valve stem formed of metal, the valve stem having an outside diameter surface profile defined by a first sequence of rings oriented in an axial direction; and a clutch disposed on the dart valve, the clutch including a split bobbin formed of a synthetic material and having an inside diameter surface profile defined by a second sequence of rings oriented in an axial direction.

In further aspects of this yet another embodiment, there are disclosed features wherein the a first and second sequences of rings are in slidable contact; wherein the first and second sequences of rings are formed to substantially the same dimensions and substantially the same a profile in cross section; wherein the first and second sequences of rings comprise an alternate sequence of ridges and grooves along a portion of the length of the stem and the bobbin on their respective outside and inside diameters; and wherein the first and second sequences of rings comprise ridges defined by the nominal diameter of the stem or bobbin plus an amplitude dimension H alternating periodically with grooves defined by the nominal diameter of the stem or bobbin less an amplitude dimension H, wherein the amplitude dimension H is defined by 0.001 inch$\leq$H$\leq$0.0045 inch.

DETAILED DESCRIPTION OF THE INVENTION

Introduction

Figure 1:
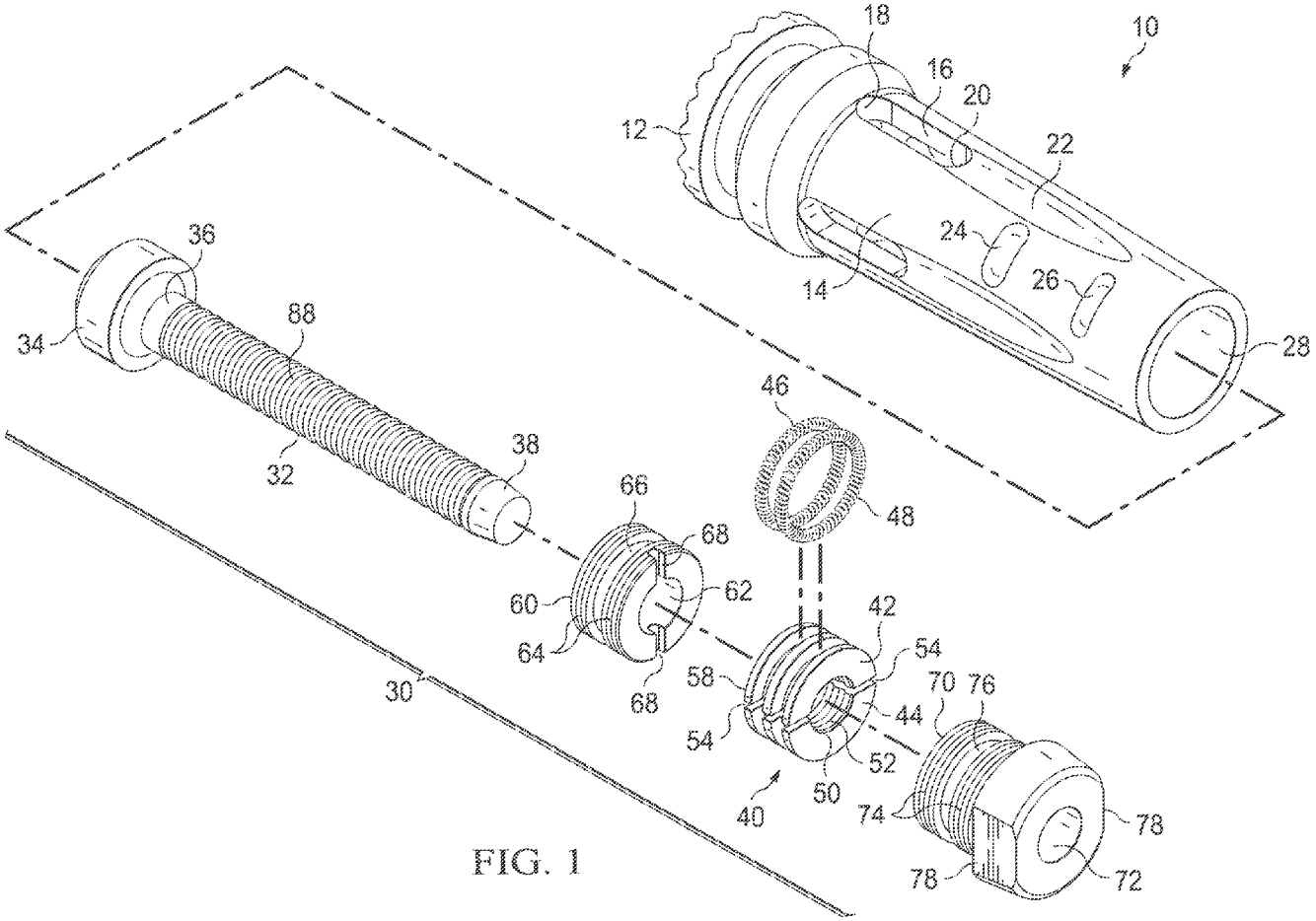
FIG. 1 illustrates an exploded perspective view of a portion of a bypass plunger and its associated dart valve and clutch assembly according to one embodiment of the invention.

In an advance in the state of the art, the embodiments described herein provide a novel dart valve assembly for use in bypass plungers and other similar devices that has an extended useful life through the use of a thermoplastic material for the body component of the clutch assembly, called a bobbin. Traditionally, the moving parts of a bypass valve assembly in plungers and related devices rely on metal materials such as stainless steel alloys because of their durability under the severe impact forces and environmental conditions encountered by downhole tools. The stainless steel alloys generally perform well, particularly in tools such as bypass plungers that are subject to repetitive impacts through many cycles of operation. Thus, the use of non-metallic materials runs counter to the prevailing practice that prefers the use of metal materials in these devices.

However, there are several properties of synthetic materials that are well-suited to use in clutches for bypass plungers. First, because of their lower mass, certain thermoplastic materials provide a superior ability to withstand the high impact forces encountered as the plunger travels within the well bore and strikes the bumper mechanism at the well bottom or the decoupling mechanism at the surface. The lower mass reduces the momentum of a clutch body or bobbin and the force of its impact with supporting structures within the valve cage of a bypass valve. Second, the resiliency of these thermoplastic materials provides better cushioning of the impacts, i.e., distribution of the impact forces that are experienced by the components of the clutch assembly. Third, forming the bobbin from certain thermoplastic materials reduces friction and wear and provides better temperature stability that enables closer tolerances to be maintained. These benefits arise primarily because of the lower mass of the thermoplastic material, its greater elasticity as compared with metal alloys, its resistance to wear, and its temperature stability.

The lower mass of the synthetic material means that the momentum (which is $\propto mv^2$) of the clutch bobbin is reduced in proportion to its mass. In one example, a thermoplastic bobbin has a mass of less than ¼ the mass of a steel bobbin. Further, the greater elasticity or resilience means that the plastic material is more readily and momentarily deformed elastically under impact with another body, whether it be an end nut or partition nut, or the garter springs used with the bobbin to form the clutch assembly. The effect of these two properties is to reduce the intensity of the impact forces on the clutch components. The effect of the impact on the springs of the bobbin is reduced because the momentary deformation of the bobbin material—and its resilience—absorbs the momentum of the springs and minimizes deformation of the metal springs. The effect of the impact of the bobbin against the end nut or partition nut is reduced for the same reason. In tests performed under actual conditions both the bobbin and the garter springs were found to survive many more cycles of the bypass plunger than clutches constructed with metal bobbins. For example, in one test through well over 10,000 cycles the plunger body wore out while the clutch assembly formed of an oil-filled Nylon bobbin and Inconel® garter springs remained intact and functional. Inconel® is a registered trademark of Special Metals Corporation, New Hartford, N.Y.

In a bypass valve cage, the outer surface of the dart valve stem and the inner surface of the clutch bobbin are necessarily in constant contact with one another. Thus, these surfaces are subject to friction and wear during the operation of the clutch assembly. In another innovation incorporated into the present invention, the cross-sectional profiles of the dart valve stem and the clutch bobbin are carefully designed to interact to provide (A) sufficient clutch engagement when holding the dart valve closed and open, while (B) permitting smooth and consistent reciprocating motion of the dart valve stem within the clutch bobbin when operating the bypass valve between the open and closed states. It has been found that forming these surfaces in contact with closely similar cross-sectional profiles while paying close attention to the dimensions of the surfaces and the relative diameters of the valve stem and clutch bobbin results in a substantial improvement in reliability and durability of the clutch assembly. Accordingly, these surfaces are configured with a "ripple feature," a periodically repeating series or sequence of smooth, low-profile rings formed around the adjoining surfaces of the valve stem and clutch bobbin. This profile—characterized by peaks (crests) and valleys (troughs) in cross section—is formed along the axial length of the outer surface of the dart valve stem and the inner surface of the bobbin. These profiles act to engage and hold the bobbin at the ends of the stroke of the dart valve stem while permitting the bobbin to disengage and slide as the dart valve reciprocates within the bobbin. This result may be optimized by ensuring the inside diameter of the bobbin is slightly greater than the outside diameter of the dart valve stem, in proportion to the amplitudes of the peaks and valleys of the ripple feature.

One subtle feature of the ripple profile is that the use of the same profile on both surfaces in contact permits using fewer peak amplitudes of the rings in the ripple profile per inch of axial a length, thereby reducing the number of times the garter springs are subjected to a vibratory impact as the dart valve stem slides through the clutch bobbin ring-by-ring between open and closed positions. Thus, increasing the spacing or period of the rings extends the life of the garter springs. Further, the motion of the valve stem within the clutch bobbin generates a vibration at a frequency determined by the spacing or period of the rings. This vibration "waveform" may include harmonics. It is believed that the life of the garter springs is inversely proportional to the vibration frequency because of the reduced bending stress imparted to the individual coils of the garter springs. Another subtle feature of the ripple profile is that wear of the adjoining rippled surfaces is reduced because of the smooth profiles.

Together these features—use of a synthetic bobbin material and the ripple profile disposed on the adjoining surfaces of both the dart valve stem and the clutch bobbin—combine to provide substantial and unexpected improvements to the reliability and durability of bypass valves used in bypass plungers and similar devices.

DETAILED DESCRIPTION

The following detailed description is intended to illustrate one preferred embodiment of the invention without limiting the forms in which the invention may be practiced. Other embodiments that utilize the same or similar or equivalent structures or functions are intended to fall within the scope and spirit of the invention. Reference numbers on the drawings that appear in more than one figure refer to the same structural features or elements.

FIG. 1 illustrates an exploded perspective view of a portion of a bypass plunger 10 and its associated dart valve and clutch assembly 30 according to one embodiment of the invention. The upper end of the bypass plunger 10 is oriented beyond the upper center portion of the drawing and the valve cage 14 is disposed at the lower end of the bypass plunger 10. The bypass plunger 10 includes a plunger body 12 and the valve cage 14, which share a common internal bore 28 throughout their length to enable the flow of fluid when the plunger 10 is descending through the well casing. The valve cage 14 includes a plurality of openings 16 in a the wall of the valve cage 14 for the passage of fluids as the bypass plunger 10 descends through a well casing after the dart valve and clutch assembly 30 has been set to open. In general at least two such openings 16 are formed in the valve cage, while in other embodiments up to four openings 16 may typically be used. The openings 16 or "ports 16," which are generally elongated, disposed parallel with the longitudinal axis of the valve cage 14, and evenly disposed around the circumference of the valve cage 14, may include several features to reduce obstructions to the flow of fluid. The upper end 18 and the lower end 20 of an opening 16 in the wall of the valve cage 14 may be rounded as shown. In addition, the lower end of each opening 20 may include a shallow, elongated relief passage 22 to provide a smoother transition into and through the port 16 formed in the valve cage 14.

The dart valve and clutch assembly 30 ("valve assembly 30" for short) includes a valve dart 32 and a clutch assembly 40 that is retained within the valve cage 14 between a partition nut 60 and an end nut 70. The valve dart 32 includes a valve stem 36 and a valve head 34 disposed at the upper or first end of the valve stem 36. The valve head 34 includes a valve face 35 (See FIG. 3A) that is shaped to mate with a valve seat 37 (See FIG. 7) formed within the upper portion of the valve cage 14 in the internal bore 28 of the valve cage 14. The internal bore 38 of the valve cage 14 includes an internal thread 29.

In a bypass plunger 10 of the type shown in FIG. 1, formed of one piece of material to provide an integral structure, the valve dart 32 is inserted head first into the valve cage 14 followed by the partition nut 60, the clutch assembly 40, and the end nut 70. The stem 36 of the valve dart 32 extends from the valve head 34 through the internal bore 28 of the valve cage 14. The partition nut 60 and the end nut 70, disposed over the stem 36, include respective external threads 64, 74 around their outer diameters to mate with respective internal threads 29 within the bore 28 of the valve cage 14. The partition and end nuts 60, 70 preferably include respective shallow grooves 66, 76 to receive protrusions 80, 82 from respective external "crimple" features 24, 26 to be explained in FIGS. 7 and 8. Slots 68 formed in the outer end of the partition nut 60 may be provided for a wrench for turning the threads 64 of the partition nut 60 into the threads 29 of bore 28. Similarly, flats 78 formed on either side of the end nut 70 may be provided for a wrench for turning the threads 74 of the end nut 70 into the threads 29 of bore 28. The valve cage 14 may include a shoulder (not shown) within the bore 28 for the partition nut 60 to bear against; or a depth gauge may be used to determine the correct position for the partition nut 60. The clutch assembly 40 is installed on the valve dart 32 and pushed along the stem 36 of the valve dart 32 to its position against the partition nut 60. The end nut 70 is then threaded into the threads 29 of bore 28 until it bears against the clutch 40, to secure the clutch assembly 40 within the valve cage 14.

Figure 7:
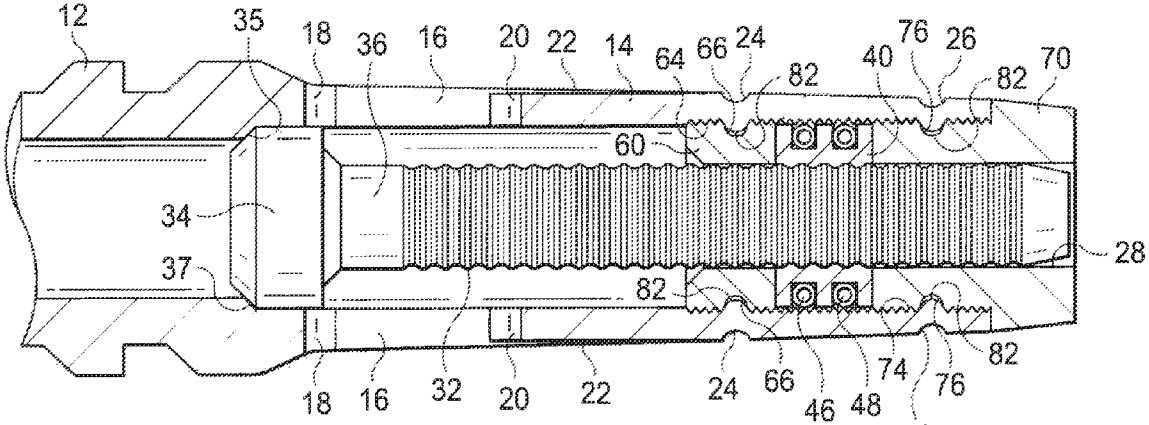
FIG. 7 illustrates a side cross section view of a portion of a bypass plunger with a dart valve assembly utilizing a synthetic clutch according to one embodiment shown in a closed position.
Figure 8:
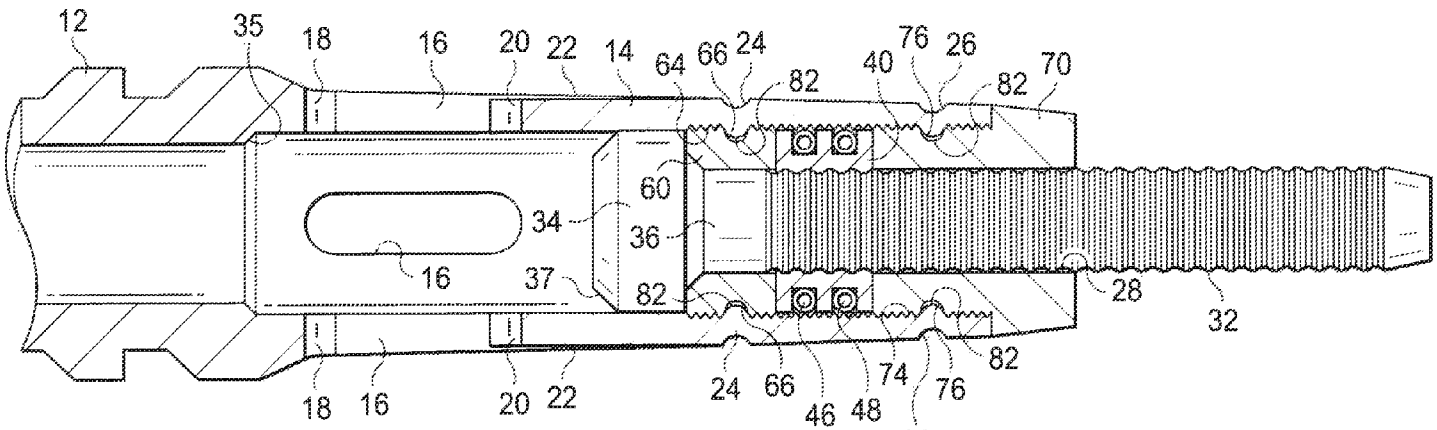
FIG. 8 depicts a side cross section view of a portion of a bypass plunger with a dart valve assembly utilizing a synthetic clutch according to one embodiment shown in an open position.

Also shown in FIG. 1 are first 24 and second 26 elongated "crimple" features for locking the threaded partition nut 60 and the threaded end nut 70 in position. The outer diameters of the partition nut 60 and the end nut 70 each include external screw threads 64, 74 to enable them to be threaded into the threads 29 of the internal bore 28 of the valve cage 14. A first shallow groove 66 is formed in the middle portion of the threads 64 of the partition nut 60. A second shallow groove 76 is formed in the middle portion of the threads 74 of the end nut 70. When the dart valve and clutch assembly 30 is installed within the valve cage 14, the first and second shallow grooves 66, 76 are aligned with the first and second crimple features 24, 26 respectively. After assembly, a press is used to press the crimple features 24, 26 inward to form projections 80, 82 that extend into the shallow grooves 66, 76, thereby locking the partition and end nuts 60, 70 into their respective positions to retain the clutch assembly 40 within the valve cage 14. This method of securing the partition and end nuts 60, 70 from loosening has been found superior to pins or set screws, which tend to shear under repeated impacts during cycling. FIGS. 7 and 8 show the assembled valve cage and dart valve assemblies, including the crimple features 24, 26 in cross section.

Continuing with FIG. 1 the first 42 and second 44 halves of the split bobbin 58 are shown in their relative positions as they will be installed on the dart valve stem 32, including the small gap 54 between their respective faces. The bobbin 58 is held in position around the valve stem 36 by first 46 and second 48 garter springs ("garters"), which exert tension through the split bobbin halves 42, 44 against the outer surface of the valve stem 36 to provide the clutch action. The outer diameter of the valve stem 36 is provided with a "ripple" finish 88, a series or sequence of rings to be described in FIGS. 3A and 3B. The inside diameter 50 of the split bobbin 58 is also provided with the "ripple" finish 52 to be described in FIGS. 3A and 3B.

Further, the outer diameters of the partition nut 60 and the end nut 70 each include respective external screw threads 64, 74 to enable them to be threaded into the internal bore 28 of the valve cage 14. A first shallow groove 66 is formed in the middle portion of the threads 64 of the partition nut 60. A second shallow groove 76 is formed in the middle portion of the threads 74 of the end nut 70. When the dart valve and clutch assembly 30 is installed within the valve cage 14, the first and second shallow grooves 66, 76 are aligned with the respective first and second crimple features 24, 26.

Figure 2:
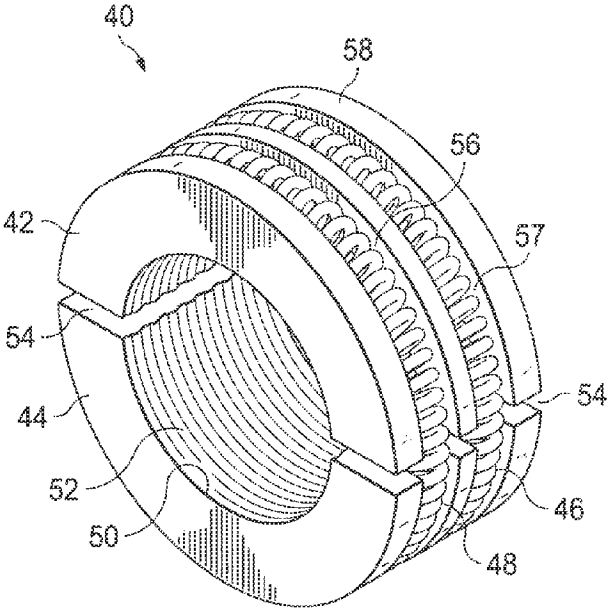
FIG. 2 illustrates an assembled split bobbin formed of a synthetic material according to an embodiment of the invention depicted in FIG. 1.

FIG. 2 illustrates a clutch assembly 40 comprising a split bobbin 58 formed of first and second hemispherical halves 42, 44 made of a synthetic material according to an embodiment of the invention depicted in FIG. 1. The split bobbin or clutch body 58—formed of the first and second hemispherical halves 42, 44—includes first and second circumferential U-shaped channels 56, 57 formed around the outer surface of the cylindrical body between the first and second ends. The bobbin halves are preferably formed of a thermoplastic material. The split bobbin 58 includes an axial bore 50 that is machined to a surface profile 52 to be described in FIGS. 3A and 3B.

The clutch assembly is completed by first and second garters 46, 48 disposed in the circumferential channels 56, 57 formed around the outer surface of the bobbin 58, thereby holding the hemispherical halves 42, 44 together when the clutch assembly 40 is installed on the dart valve stem 36 of the bypass plunger 10. The garters may preferably be coil springs as shown in FIG. 2 or other resilient material formed in a ring and having sufficient tension to remain within the U-shaped channels 56, 57 thereby to secure the two hemispherical halves 42, 44 of the bobbin 58 around the valve stem 36 of the valve dart 32. The assembly of FIG. 2 depicts the gap 54 that will exist when the bobbin 58 is disposed on the valve stem 36. Further details of the clutch body are described in FIGS. 3A and 3B herein below.

Figure 3A:
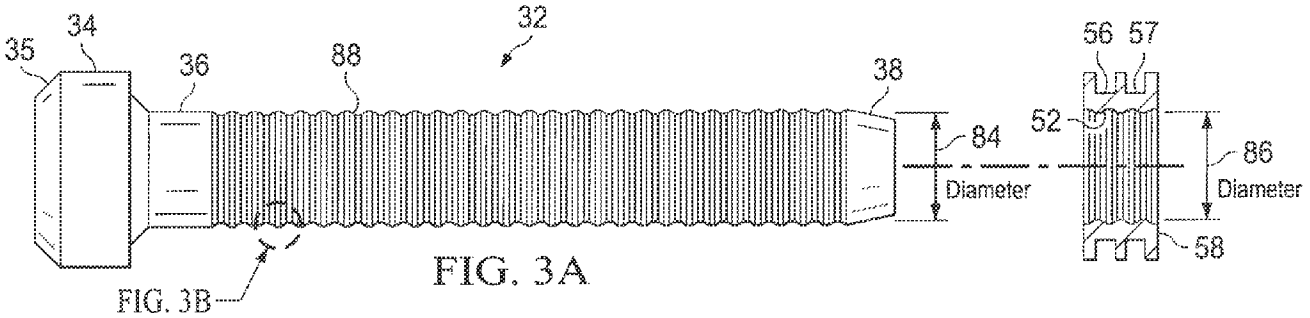
FIG. 3A illustrates an axial cross section view of the surface profile of a dart valve stem and a clutch body according to the embodiment of FIGS. 1 and 2.
Figure 3B:
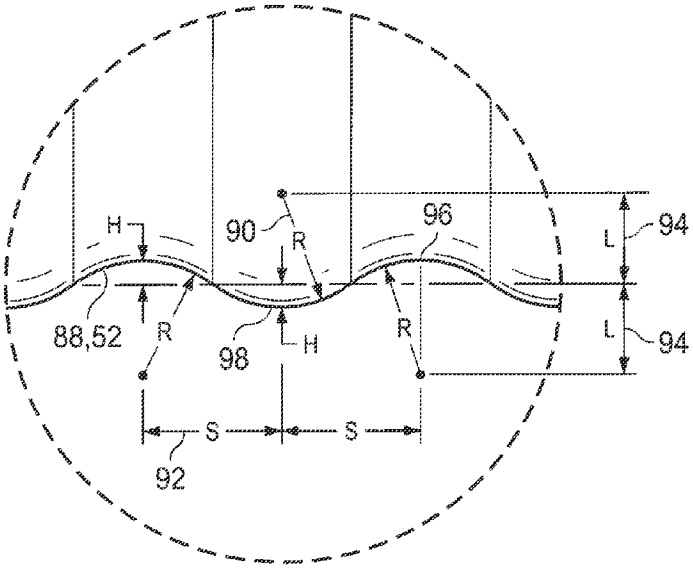
FIG. 3B illustrates an enlarged cross section view of the surface profile of the dart valve stem and clutch body shown in FIG. 3A.

FIG. 3A illustrates an axial cross section view of a dart valve stem 36 and clutch bobbin 58 of the embodiment of FIGS. 1 and 2. FIG. 3B illustrates an enlarged detail view of the surface profile 88 of the dart valve stem 36 and the surface profile 52 of the clutch bobbin 58 depicted in FIG. 3A. The surface profiles 88 and 52 define the respective outside diameter of the valve stem 36 and the inside diameter of the split bobbin 58. The surface profiles 88, 52 preferably comprise a uniform series of alternating and rounded ridges (crests) and grooves (valleys). The rounded ridges and grooves of the surface profiles 88, 52 are provided to enable a prescribed amount of resistance to the valve stem 36 sliding within the clutch bobbin 58 as the valve dart 32 is opened or closed. The surface profiles 88, 52 also enable the clutch to retain the valve stem 36 in a clutched condition under the tension provided by the garter springs 46, 48 during descent or ascent of the bypass plunger 10. In operation, the clutch assembly 40 thus damps and restrains the motion of the valve dart 32 as it moves between the open and closed positions of the valve 35/37 to configure the bypass plunger 10 for descent or ascent in the well bore.

The ridges and grooves of the "ripple" or surface profiles 88, 52 in this particular example, as shown in the detail of FIG. 3B form a sequence of rings around the outside diameter of the valve stem 36 and the inside diameter of the clutch bobbin 58. The sequence of rings may be provided by a series of alternating arc segments disposed end-to-end with the chord of the arc segments aligned along, i.e., co-linear with, the proximate nominal surface diameters of the valve stem 36 and the bobbin 58. The arc segments are preferably circular. The positive are segment extends upward in the figure to a peak amplitude H (96) and the negative arc segment extends downward to a peak amplitude H (98). The value of the positive and negative peak amplitudes 96, 98 is defined respectively by the variable H=+/−(R−L) where L is the offset dimension 94 relative to the nominal surface diameters of the valve stem OD and the bobbin ID. R is the radius 90 of the arc segment relative to a center along the offset dimension 94 disposed either side of the nominal surface diameters 84, 86 depicted in FIG. 4A. The inside diameter 86 of the bobbin 58 will necessarily be slightly more than the outside diameter 84 of the valve stem 36. The distance L is <R. The variable S represents the pitch or spacing 92 of the arc segments and is set equal to the length of the chord of an arc segment, as determined by the value of the offset dimension 94=L.

The are segments of the surface profile 80 may be formed in one embodiment to a radius R of 0.050 inch and a pitch or spacing S of 0.060 inch. The offset dimension in this example is preferably L=0.048 inch, which yields a value for H of 0.002 inch. In a preferred embodiment H is set at H=0.0025 inch and the value of L, R, and S set accordingly. In a second embodiment, the surface profile 88, 52 may be formed as a sinusoid having peak values relative to the nominal surface diameters H=+/−(R−L) where L is the offset dimension 94 relative to the nominal surface diameters of the valve stem OD and the bobbin ID, and a sinusoidal period=2×S.

The invention is not limited to these particular dimensions, although in practice they have functioned well in typical applications. FIGS. 3A and 3B illustrate one example that is subject to variation to adapt the invention to a variety of other applications. In general, for the example described above, the peak-to-peak value of the ripple profile in practice should be approximately 2H or, in this example, 0.0045±0.003 inch, and the pitch of the ripple, 2S, should be approximately 0.120 (2×S) inch within a range of about 0.080 inch to 0.300 inch in most applications, depending on the diameter of the valve stem. The ripple profile is defined by a radius R of approximately 0.050 inch (for a spacing S of 0.060 inch as in this example) and the corresponding peak value H would be approximately ±0.0023 inch either side of the nominal surface of the dart valve stem. Thus it is readily apparent that the peak-to-peak amplitude of the ripple profile—the value 2H—whether defined by a sinusoid or as described previously, is very small compared with the radius dimension or the diameter of the dart valve stem.

Accordingly, as described, a ripple profile 88 is produced by the variable diameter surface of the round dart valve stem 36, wherein the diameter of the stem 36 varies uniformly, smoothly, and periodically between a greater first diameter (the ridge or crest) and a lesser second diameter (the groove or valley) from a first position (e.g., proximate the head 34) along the stem 36 to a second position (e.g., opposite the head 34) along the stem 36. The series of variable diameters forms a regularly-spaced sequence of separate rings forming rounded, alternate peaks and valleys. In contrast, a screw thread, though similar, is produced by a continuous, helical groove around the stem, not a series of separate rings and grooves around the stem that are not connected with each other. This difference of structure is important because only the smoothly rounded peaks (ridges or crests and grooves or valleys) provide the well-controlled restraint as the valve stem 36 slides within the clamping tension of the bobbin 58. Moreover, a helical groove formed with the profile of a screw thread, because it is designed to grip the adjoining thread, not let it slide smoothly there along, cannot be made to reliably provide the well-controlled restraint mentioned above without inconsistent, erratic motion.

Also shown in FIG. 3A is the profile of the U-shaped channels 56, 57 formed circumferentially around the clutch bobbin 58. Although not shown in the figures, the inside lower corner portions of the channels 56, 57 may preferably be formed to include a small radius of 0.020 inch.

Figure 4:
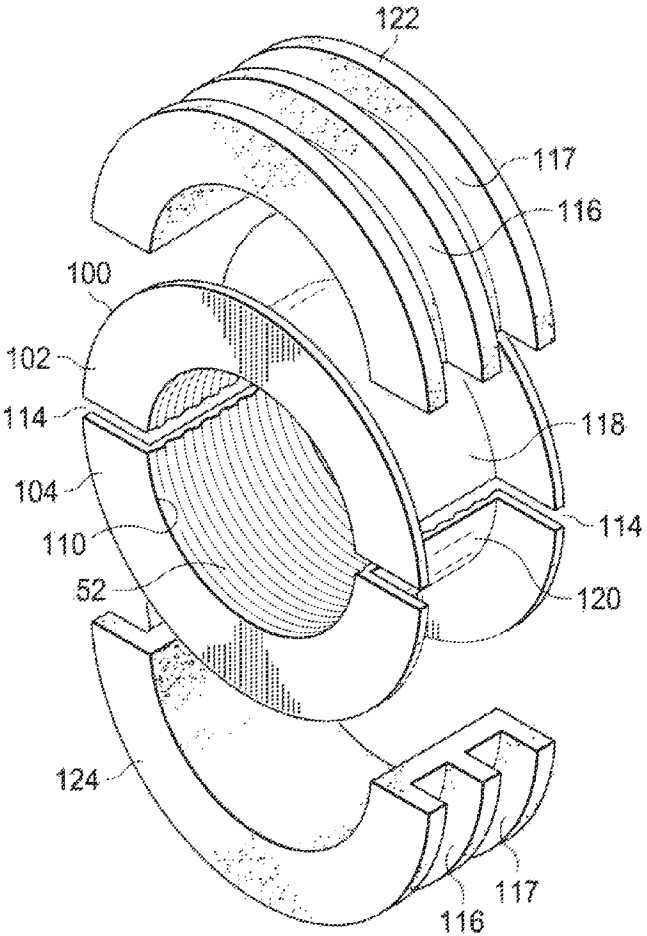
FIG. 4 illustrates an exploded view of a split metal bobbin having a reduced mass and a pair of bobbin inserts formed of synthetic material according to an embodiment of the invention.
Figure 6:
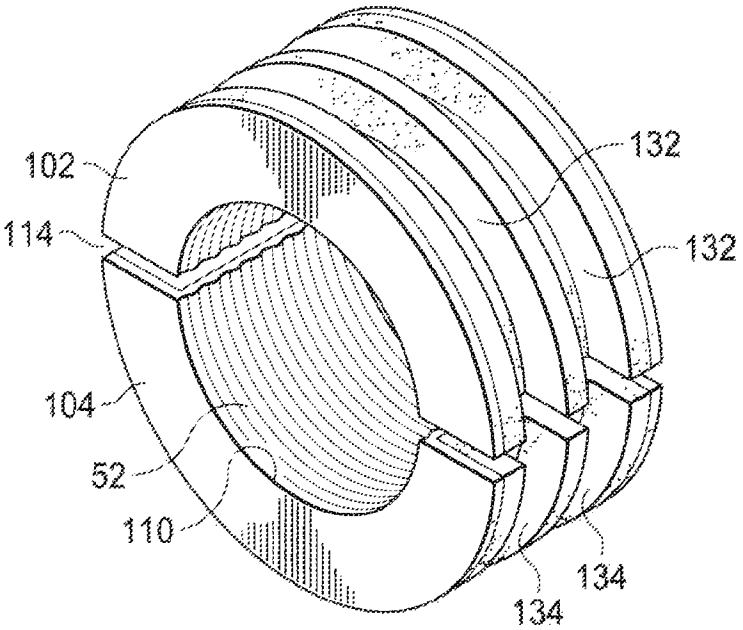
FIG. 6 illustrates an alternate embodiment of an assembled split bobbin formed of metal and having its outer diameter surfaces coated with a synthetic material.
Figure 5:
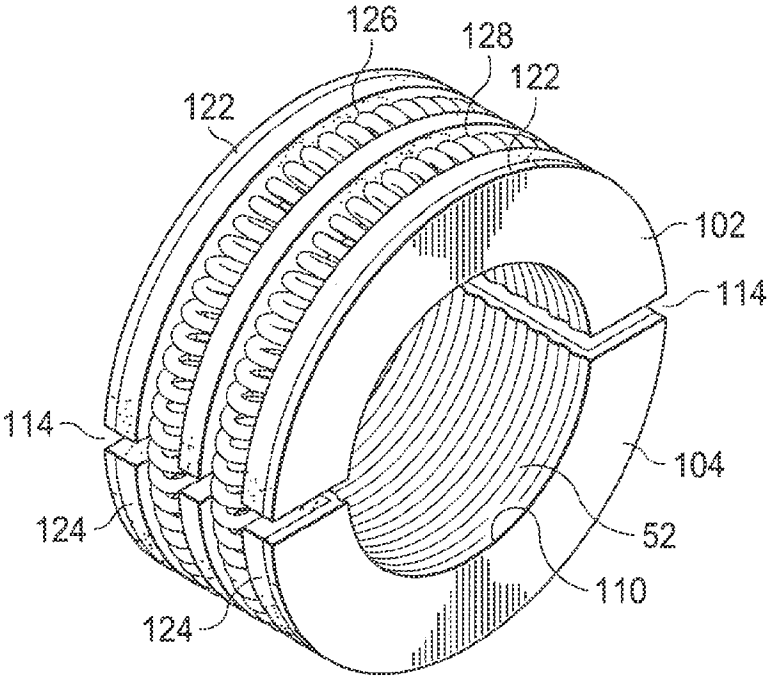
FIG. 5 illustrates the bobbin embodiment of FIG. 4 assembled with garter springs installed within the synthetic inserts.

FIGS. 4, 5 and 6 depict alternative embodiments of the clutch assembly wherein a reduced mass metal bobbin is formed to accept synthetic inserts or a synthetic coating to supply the cushioning of the garter springs in the spring channels. FIG. 4 illustrates an exploded view of two halves 102, 104 of a split metal bobbin 100 for the clutch assembly 40. The split metal bobbin 100 of FIG. 4 has a reduced mass and first and second bobbin inserts 122, 124 formed of synthetic material according to an embodiment of the invention. The bobbin inserts 122, 124 fit into respective undercut portions 118, 120 of the outer diameter of the bobbin halves 102, 104. The undercut portions 118, 120, by removing metal, reduce the mass of the bobbin 100. Each first and second bobbin insert 122, 124 includes a first and second circumferential U-shaped channel 116, 117 formed around the outer surface of the bobbin inserts 122, 124. The metal bobbin 100 is shown with an inside diameter surface 110 that includes the surface ripple feature 52 as described herein above. FIG. 4 also shows the gap 114 between the ends of the split bobbin halves 102, 104.

FIG. 5 illustrates the bobbin embodiment of FIG. 4 assembled with first and second garter springs 126, 128 installed within the first and second circumferential U-shaped channels 116, 117 formed in the first and second synthetic inserts 122, 124.

FIG. 6 illustrates an alternate embodiment, which may be used to adapt the clutch assembly 40 to an alternate manufacturing process. The split bobbin is similar in all respects to the assembly shown in FIG. 4 except the synthetic inserts 122, 124 are replaced by first 132 and second 134 synthetic coatings over the outer portions of the bobbin halves 102, 104.

FIG. 7 illustrates a side cross section view of one embodiment of the assembled dart valve and clutch 30 of FIG. 1 for a bypass plunger 10 (or similar device) that utilizes the synthetic clutch bobbin and "ripple" features disclosed herein. The valve dart valve 32 is shown in a closed position within the end of a plunger body 12. This figure depicts the valve dart 32 installed within the synthetic clutch assembly 40, which is retained between a partition nut 60 and an end nut 70. The partition nut 60 and the end nut 70 include external threads, respectively 64, 74 formed into their outer surfaces. These external threads 64, 74 mate with corresponding internal threads 29 cut into the longitudinal bore of the cylindrical valve cage 28. The outer diameters of the partition nut 60 and the end nut 70 each include respective external screw threads 64, 74 to enable them to be threaded into the internal bore 28 of the valve cage 14. A first shallow groove 66 is formed in the middle portion of the threads 64 of the partition nut 60. A second shallow groove 76 is formed in the middle portion of the threads 74 of the end nut 70. When the dart valve and clutch assembly 30 is installed within the valve cage 14, the first and second shallow grooves 66, 76 are aligned with the respective first and second crimple features 24, 26. After assembly, a press is used to press the crimple features 24, 26 inward to form projections 80, 82 that extend into the shallow grooves 66, 76, thereby locking the partition and end nuts 60, 70 into their respective positions to retain the clutch assembly 40 within the valve cage 14.

The partition nut 60 is so called because it forms a partition or bulkhead within the longitudinal bore of the hollow dart valve cage 14 of the bypass plunger. The partition nut 60 thus defines the position of the clutch assembly 40 within the valve cage 14, allowing sufficient room for the stroke of the valve dart 32 as it reciprocates between its open and closed positions. The clutch assembly 40 is also constrained by the end nut 70 so that the clutch assembly 40 is held in a fixed position within the valve cage 14. The clutch assembly 40 controls the reciprocating motion of the valve dart 32 and retains the valve dart 32 in its closed and open positions as it traverses the well bore.

The proximate first end of the plunger body 12, formed in the illustrated embodiment as the valve cage 14 includes a valve dart 32 that reciprocates within the valve cage 14 to close and open the dart valve. The dart valve is formed of a valve face 35 (of the valve head 34) and a valve seat 37 (formed in the proximate end of the plunger body 12). The valve face 35 is shaped to make a sealing contact with a valve seat 37 to close the path for fluid flow through the plunger body 12. The valve 35/37 is opened (see FIG. 8) when the plunger reaches the surface to enable the plunger to descend through the well bore. When the plunger strikes a bumper spring or other similar device at the well bottom, the valve dart 32 is forced inward of the valve cage 14 to close the dart valve 35/37, thus sealing off the fluid flow path so that pressure in the well can act to lift the bypass plunger 10 toward the surface, along with gas and/or fluids accumulated at or near the bottom of the well.

Other features of the exemplary valve cage include the plurality of elongated openings or ports 16 that are formed in the walls of the valve cage 14. The ports 16 include the rounded cut ends 18 and 20. The lower end of each opening 20 may include a shallow, elongated relief passage 22 to provide a smoother transition into and through the port 16 formed in the valve cage 14.

FIG. 8 depicts the same structural features as illustrated in the side cross section view of FIG. 7 except that the dart valve is shown in an open position.

Thermoplastic materials suitable for the synthetic bobbin 58 or the synthetic bobbin coatings or inserts 100 should satisfy the following suggested physical properties. These materials are much lower in mass compared to the metals commonly used in down-hole tools and thus provide certain advantages when low inertia contributes to longer life and reliability.

Tensile elongation at break: 20% or higher.
Water absorption, 24 hours: 0.50% or lower.
Flexural Strength: 14,000 psi or higher.
Maximum Operating Temperature: 230° F. or higher.
Heat Deflection Temperature: 300° F. or higher.
Coefficient of Friction: 0.040 or lower.

Suitable examples of thermoplastic materials may be selected from the group of synthetic polymers that includes:
Polyamides such as unfilled, or oil-filled or molybdenum-filled nylon.
Polyetherketone (PEEK).
Polyaryletherketone (PAEK).
Polyphenylene sulfide.
Polyetherimide (PEI).

The filled thermoplastics may include substances such as mineral oil or $MoS_2$, molybdenum disulfide, a solid lubricant, to impart certain properties as reduced friction, improved temperature stability, and improve wear properties of the thenrmoplastic material. Other suitable materials include natural rubber and synthetic rubber products such as Neoprene, Nitrile, Silicone, Fluorosilicone and Fluorocarbon compounds, etc.

The clutch portion 40 of the dart valve and clutch assembly 30 preferably includes a split bobbin 58 made of an elastic, resilient, thermoplastic material that allows it to deform elastically during an impact thereby substantially reducing the effect of the impact forces as the bypass plunger 12 contacts the bottom of the well or the decoupling mechanism at the surface. The split bobbin 58 of the clutch, held against the valve dart or stem 32 by encircling garter springs 46, 48, is retained in position within the valve cage 14 between a partition nut 60 and an end nut 70, both of which may be secured within the cage by screw threads and a locking mechanism to lock them in place. During operation of the bypass plunger the dart valve 32 is permitted to move within the valve cage 14 between a first (closed) position with the valve seated against the valve seat and a second (open) position with the valve disposed past at least one fluid passage formed through the side wall of the hollow body or valve cage. The fluid passage(s) 16 permits the bypass plunger 12 to fall through the well bore as fluids in the well bore pass through the passages in the valve cage wall.

A second feature of the dart valve and clutch assembly 30 is the longitudinal ripple profile of the cylindrical surfaces of the outer diameter of the dart valve stem and the inner diameter of the clutch bobbin. This profile 52, 88 is oriented along the adjacent surfaces of the assembled dart valve and clutch 30 in the longitudinal direction parallel to the longitudinal axis. The profile is preferably a repeating sequence of uniform rings—smooth variations of periodic, alternate peaks and valleys along the respective diameter of the cylindrical surfaces. The dart valve head 34 is held in a closed or open position by the interlocking peaks and valley profiles of the dart valve stem 32 and clutch bobbin 58 under the nominal clamping force provided by the garter springs 46, 48 of the clutch. The profiles are preferably also smooth and rounded to allow the dart valve stem to slide through the clutch bobbin with minimal impediment as the dart valve is operated to the open or closed position. The combined effect of the synthetic bobbin and the peak-and-valley ripple profiles provides both (a) a well-controlled operation of the dart valve and clutch assembly 30 and (b) a very substantial and unexpected extension of the useful life of bypass plungers that include this combination in their dart valve structures. In an alternate embodiment, a sinusoid profile oriented along the cylindrical surfaces of both the dart valve stem and the inside diameter of the bobbin may be used to provide the peak-and-valley ripple profile.

CONCLUSION

The embodiments described herein provide a novel clutch assembly for use in bypass plungers and other similar devices that has an extended useful life through the use of a thermoplastic material for the body component of the clutch assembly, called a bobbin. Because of their lower mass, certain thermoplastic materials provide a superior ability to withstand the high impact forces encountered as the plunger strikes the bumper mechanism at the well bottom or the decoupling mechanism at the surface. The lower mass reduces the momentum of a clutch body and the force of its impact with supporting structures within the valve cage of a bypass valve. Further, the resiliency of these thermoplastic materials provides better cushioning and distribution of the impact forces experienced by the clutch assembly. Moreover, forming the bobbin from certain thermoplastic materials reduces friction and wear and provides better temperature stability that enables closer tolerances to be maintained.

In another innovation incorporated into the present invention, the cross-sectional profiles of the dart valve stem and the clutch bobbin are configured with a "ripple feature," a periodically repeating series of smooth, low-profile rings formed around the adjoining surfaces of the valve stem and clutch bobbin. This profile—characterized by peaks (crests) and valleys (troughs) in cross section—is formed along the axial length of the dart valve stem and the inner surface of the bobbin. These profiles act to engage and hold the bobbin at the ends of the stroke of the dart valve stem while permitting the bobbin to disengage and slide as the dart valve reciprocates within the bobbin.

A further advantage of the illustrated embodiment is its adaptability for use as a replacement for conventional clutch assemblies to extend the useful life of bypass plunger devices or other down-hole tools that employ such clutches.

While the invention has been shown in only one of its forms, it is not thus limited but is susceptible to various changes and modifications without departing from the spirit thereof.

What is claimed is:

1. A dart valve assembly for a bypass plunger wherein a dart valve including a valve stem having an outside surface diameter is disposed within a clutch bobbin having an inside surface diameter in contact with the outside surface diameter of the valve stem, comprising:

a clutch bobbin formed of synthetic material disposed around the valve stem; and a surface profile formed axially along the inside surface diameter of the clutch bobbin and along the outside surface diameter of the valve stem; wherein the surface profile formed in the clutch bobbin is substantially the same as formed on the valve stem and includes a series of uniform arc segments forming periodically alternating crests and valleys in the region of contact.

2. The assembly of claim 1, wherein the uniform arc segments comprise:

circular arc segments disposed end-to-end along the respective surfaces; and the circular arc segments face alternately inward and outward of the respective surfaces of the bobbin and the dart valve stem thereby forming the alternating crests and valleys.

3. The assembly of claim 2, wherein the arc segments are defined by:

a radius R relative to a center disposed either side of the respective surfaces by a distance L such that R−L=H, where H is the peak excursion of each crest and valley from the respective surface;

a spacing S equal to the length of the chord of an arc segment; wherein $0.001 \leq H \leq 0.004$ inch.

4. The assembly of claim 3, wherein the values of R, S, and H respectively comprise:

R=0.050 inch;

S=0.060 inch; and

H=0.0025 inch.

5. The assembly of claim 1, wherein the surface profile comprises a sinusoid having:

a peak amplitude value H=+/−(R−L) relative to the nominal surface diameters where L defines a center of a radius R relative to the nominal surfaces of the valve stem OD and the bobbin ID; and a period 2×S where S=base dimension of each crest and valley.

6. The dart valve assembly of claim 1, wherein the synthetic material comprises:

a thermoplastic material selected from the group consisting of oil filled nylon, unfilled nylon, filled and unfilled polyetheretherketone, polyaryletherketone, polyetherimide, polyphenylene sulfides, polyamides and variations thereof.

7. The dart valve assembly of claim 1, wherein the bobbin comprises:

at least first and second arcuate bodies, having at least one circumferential groove formed in the outer diameter of each arcuate body, that together substantially encircle the valve stem.

8. The dart valve assembly of claim 1, wherein the clutch comprises:

at least first and second arcuate bodies that together substantially encircle the valve stem; and a garter spring disposed in at least one circumferential groove disposed around the outside of the first and second arcuate bodies and securing the at least first and second arcuate bodies against the valve stem.

9. The dart valve assembly of claim 8, wherein the first and second arcuate bodies comprise:

first and second substantially hemispherical bodies having at least one circumferential groove formed in the outer diameter of each hemispherical body, that together substantially encircle the valve stem.

10. A dart valve assembly for a bypass plunger, comprising:

a dart valve formed of metal, having a valve head attached to a first end of a cylindrical valve stem, the valve stem having an outside diameter (O.D.) surface defined by a first longitudinal surface profile;

a clutch disposed around the dart valve stem, the clutch including a split bobbin surrounded by at least one garter spring, the split bobbin formed of a synthetic material and having an inside diameter (I.D.) surface defined by a second longitudinal profile; wherein the first and second longitudinal profiles of adjacent cylindrical surfaces of the dart valve stem O.D. and the split bobbin I.D. each comprise a uniform sequence of equal amplitude ridges alternating with equal amplitude grooves around the dart valve stem O.D. and the split bobbin I.D. such that the grooves are defined by the nominal diameter of the stem or bobbin less an amplitude dimension H and the ridges are defined by the nominal diameter of the stem or bobbin plus an amplitude dimension H; and wherein the first and second surface longitudinal profiles are substantially the same and the amplitude dimension H is defined by 0.001 inch≤H≤0.0045 inch.

11. The assembly of claim 10, wherein the synthetic material from which the bobbin is formed comprises:

a thermoplastic material selected from the group consisting of oil filled nylon, unfilled nylon filled and until led polyetheretherketone, polyaryletherketone, polyetherimide, polyphenylene sulfides, polyamides and variations thereof.

12. The dart valve assembly of claim 10, wherein the clutch comprises:

at least first and second substantially hemispherical bodies that together substantially encircle the valve stem, the first and second bodies having at least one circumferential groove formed in the outer diameter of each hemispherical body; and a garter spring disposed in at the least one circumferential groove disposed around the outside of the first and second substantially hemispherical bodies and securing the at least first and second substantially hemispherical bodies against the valve stem.

13. A dart valve assembly for a bypass plunger wherein the dart valve assembly comprises:

a dart valve having a valve head and a cylindrical valve stem formed of metal, the valve stem having an outside diameter surface profile defined by a first sequence of rings oriented in an axial direction; and a clutch disposed on the dart valve, the clutch including a split bobbin formed of a synthetic material and having an inside diameter surface profile defined by a second sequence of rings oriented in an axial direction; wherein the first and second sequences of rings form substantially the same profile.

14. The assembly of claim 13, wherein the first and second sequences of rings are in slidable contact.

15. The assembly of claim 13, wherein the first and second sequences of rings are formed to substantially the same dimensions in cross section.

16. The assembly of claim 13, wherein the first and second sequences of rings comprise:

an alternate sequence of ridges and grooves along a portion of the length of the stem and the bobbin on their respective outside and inside diameters.

17. The assembly of claim 13, wherein the first and second sequences of rings comprise:

ridges defined by the nominal diameter of the stem or bobbin plus an amplitude dimension H alternating periodically with grooves defined by the nominal diameter of the stem or bobbin less an amplitude dimension H; wherein the amplitude dimension H is defined by 0.001 inch≤H≤0.0045 inch.

18. The assembly of claim 13, wherein the synthetic material from which the bobbin is formed comprises:

a thermoplastic material selected from the group consisting of oil filled nylon, unfilled nylon filled and unfilled polyetheretherketone, polyaryletherketone, polyetherimide, polyphenylene sulfides, polyamides and variations thereof.

19. The assembly of claim 13, wherein the clutch comprises:

at least first and second substantially hemispherical bodies that together substantially encircle the valve stem, the first and second bodies having at least one circumferential groove formed in the outer diameter of each hemispherical body; and a garter disposed in each at least one circumferential groove disposed around the outside of the first and second substantially hemispherical bodies and securing the at least first and second substantially hemispherical bodies against the valve stem.

20. The assembly of claim 19, wherein the garter comprises:

a coil spring formed of metal having coils oriented normal to the longitudinal axis of the spring or canted at an angle to the longitudinal axis of the spring.

* * * * *